United States Patent [19]

Bolton et al.

[11] 4,225,991

[45] Oct. 7, 1980

[54] FABRIC WASHING SYSTEM

[75] Inventors: Joseph A. Bolton, Glens Falls; Olavi A. Huhtala, Scotia, both of N.Y.

[73] Assignee: Albany International Corp., Menands, N.Y.

[21] Appl. No.: 29,540

[22] Filed: Apr. 12, 1979

[51] Int. Cl.[3] ..... D06B 1/02; D06B 15/00

[52] U.S. Cl. ..... 8/151; 15/306 A; 68/20; 68/205 R; 134/21

[58] Field of Search ..... 8/151; 68/20, 205 R, 68/5 E; 34/155; 118/50; 15/306 R, 306 A, 307, 321, 322; 134/21

[56] References Cited

U.S. PATENT DOCUMENTS

| | | | |
|---|---|---|---|
| 883,536 | 3/1908 | Gessner | 15/306 A X |
| 1,750,496 | 3/1930 | Stride | 68/20 |
| 2,729,536 | 1/1956 | Pull et al. | 68/205 R X |
| 3,747,155 | 7/1973 | Koellisch | 15/321 X |
| 3,913,241 | 10/1975 | Chaikin et al. | 34/155 X |
| 3,919,729 | 11/1975 | Cannan | 15/321 X |
| 3,997,928 | 12/1976 | Leifeld | 68/20 X |

FOREIGN PATENT DOCUMENTS

| | | | |
|---|---|---|---|
| 610500 | 3/1935 | Fed. Rep. of Germany | 8/151 |

*Primary Examiner*—Philip R. Coe

[57] ABSTRACT

A system and method for cleaning and drying porous fabrics such as tufted carpet are disclosed. A porous fabric is first wetted and then passed over a slotted vacuum pipe. A backup plate is positioned opposite the slot, and the fabric passes between the slot and plate. Air is forced to flow in an indirect route into the slot to maximize cleaning and drying. The gap between the slot and backup plate is adjustable to enable the system to handle fabrics or carpets of varying thickness.

19 Claims, 5 Drawing Figures

FIG. 2
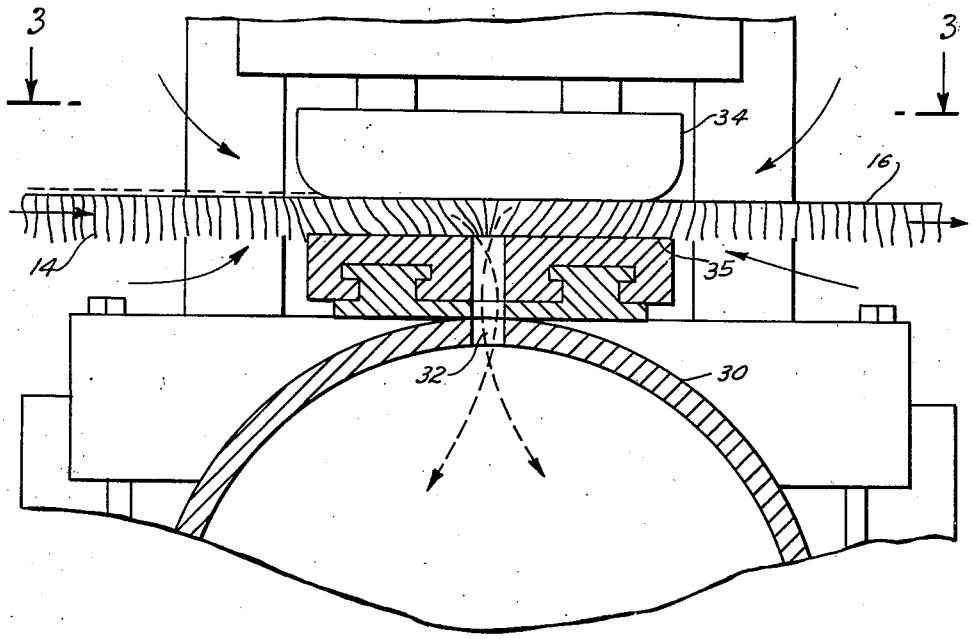
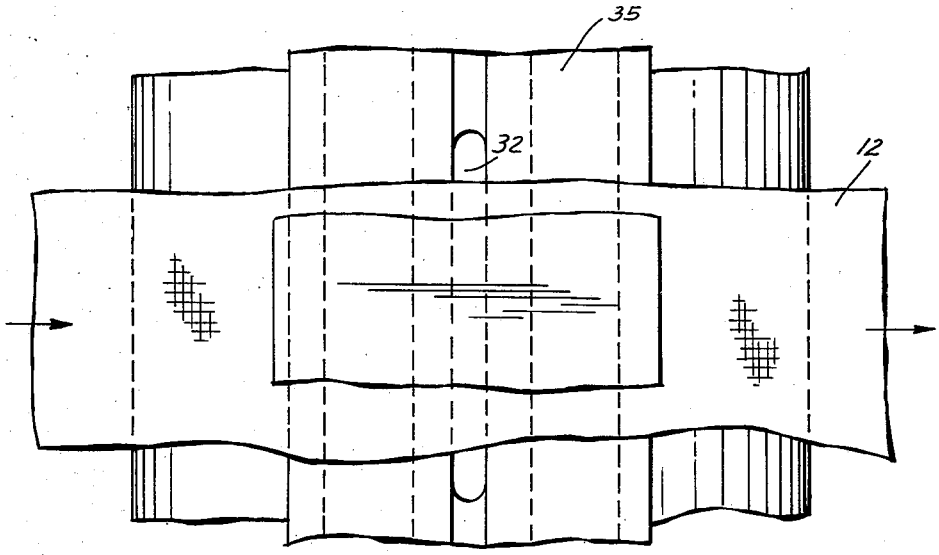
FIG. 3

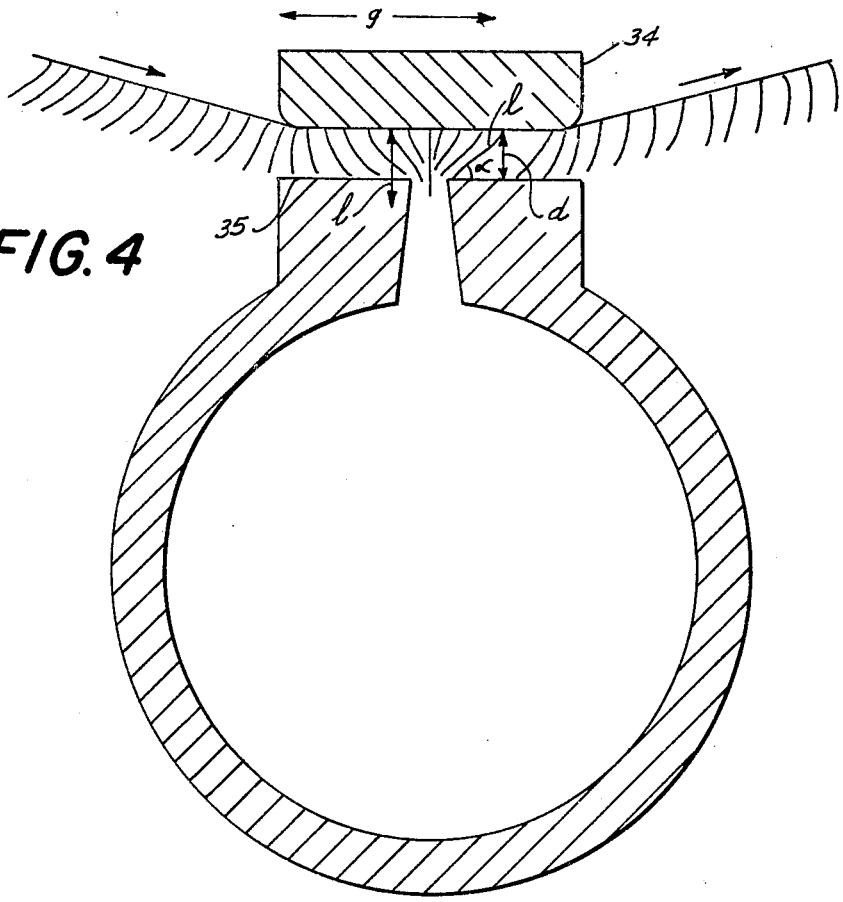
FIG. 4
FIG. 5
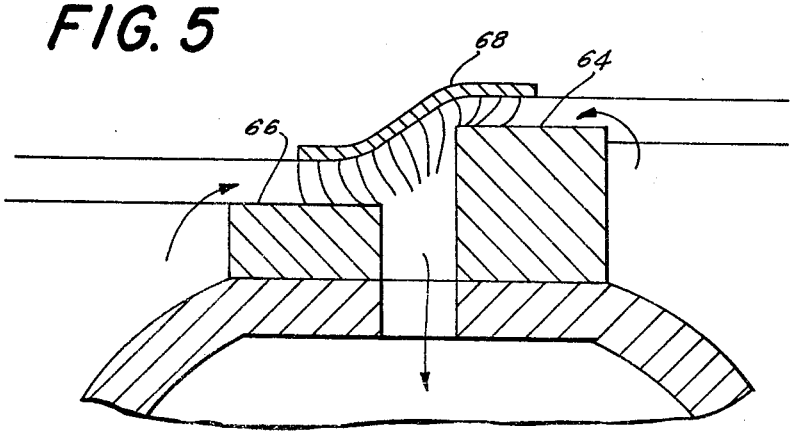

FABRIC WASHING SYSTEM

BACKGROUND OF THE INVENTION

The field of the invention relates to a system for washing fabrics such as carpets or textiles.

Fabrics have been cleaned by using any one of several techniques. They may be immersed in a wash bath and then dried by using high pressure squeeze rolls, vacuum slots, and drying ovens. Other systems have provided face side washing whereby a shower nozzle and vacuum slot are positioned on one side of the fabric. The backing of the fabric is not wetted in such a system.

The previous best method for removing gums from carpet fiber after steaming to set the dye has been to spray the back of the carpet with hot water and then to vacuum extract from the face side with standard vacuum slots. Other previous methods included the washing of the carpet in hot water with agitation to improve the removal of residuals.

The major disadvantages of these methods has been inadequate removal, particularly of the viscous gums that were used to control the dyes prior to and during the steaming operations. Residual gums present in carpet due to inadequate removal result in higher flammability and greater tendency to soiling of the finished carpet.

U.S. Pat. Nos. 3,922,738 and 3,938,356 are examples of fabric treating devices employing some of the abovementioned techniques. Commonly assigned U.S. Pat. No. 3,836,428 discloses an adjustable slot mounted on a suction pipe for vacuum conditioning felt designs.

SUMMARY OF THE INVENTION

It is an object of the invention to provide a system which provides through fabric washing without the need for immersing it in a wash bath.

Another object of the invention is to direct an air flow through the fabric in the most efficient and energyconserving manner.

Still another object of the invention is to improve the removal of residual gums to provide a cleaner finished carpet with reduced flammability and greater resistance to soiling.

With these and other objectives in mind, a washing system is provided having means by which a fabric is essentially wetted on one side and subjected to vacuum treatment on the other side. The fabric will accordingly be wetted throughout.

A plurality of water sprays are directed at the back side of a carpet into a roll nip to force the water towards the face fibers. As the carpet passes over a suction pipe havine one or more slotted openings, it is wet throughout. An air restriction means positioned against or near the back side of the carpet opposite a slotted opening increases the efficiency of the system. A greater drop in pressure across the carpet is provided and the air must flow in a more indirect route. It thereby contacts more of the material surface at a relatively high velocity. Increased dewatering is accordingly provided. In addition, the tufts on the face of the carpet spend more time within the slotted opening and are more effectively cleaned.

Additional showers and suction pipes may be included within the system if necessary.

BRIEF DESCRIPTION OF THE DRAWINGS

FIG. 2 is a sectional elevation view of the suction assembly within the system;

FIG. 3 is a plan view showing the fabric passing over a slotted suction pipe;

FIG. 4 is an enlarged elevational view of the suction assembly showing the length over which the vacuum slot is effective; and FIG. 5 is a side elevation view of an alternative embodiment of the invention.

DESCRIPTION OF THE INVENTION

Figure 1:
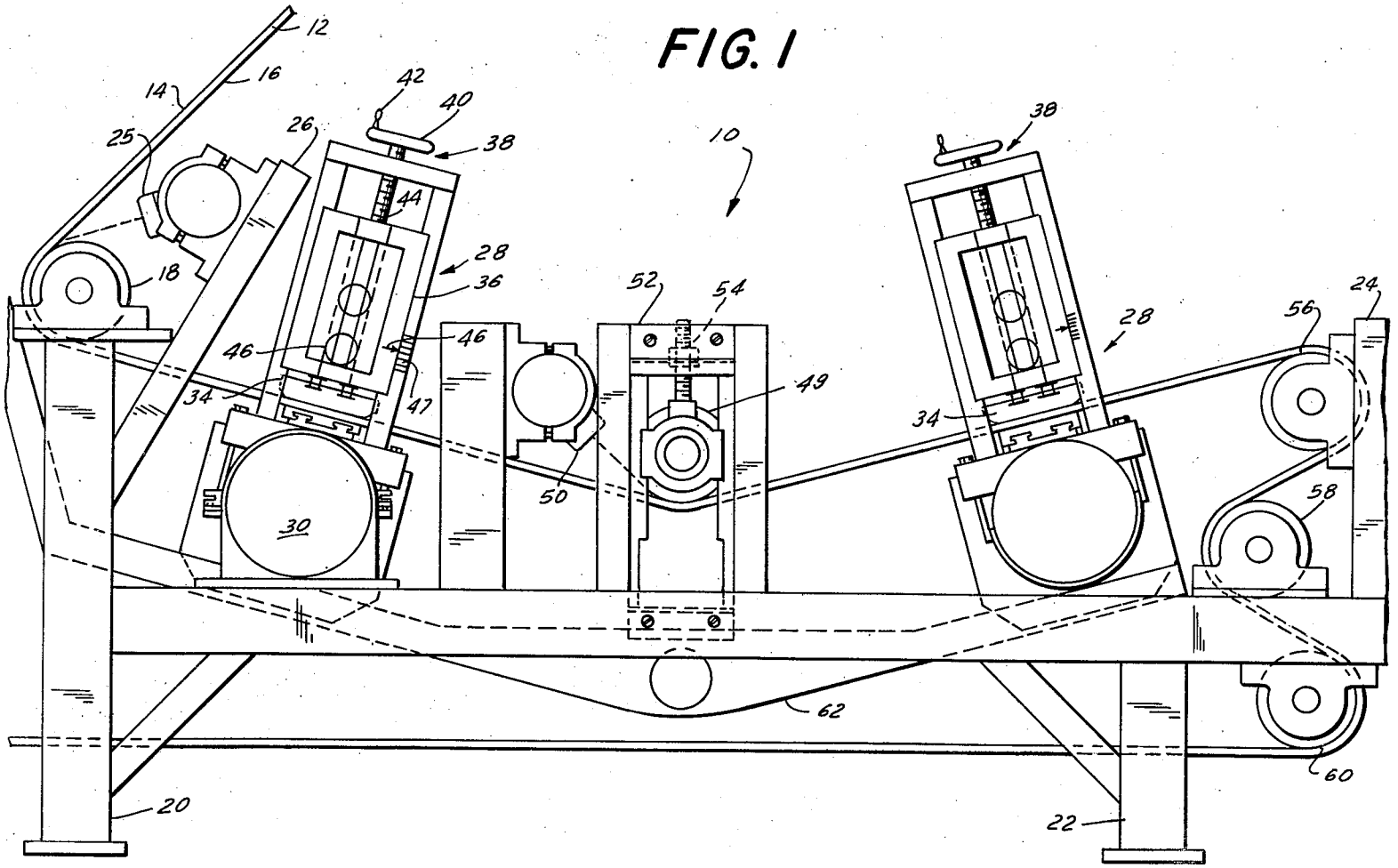
FIG. 1 is a side elevation view of the fabric washing system.

The invention is directed to a system for the washing of a fabric such as carpet. In many cases, particularly with unbacked carpet, it is desirable to completely wet a fabric without having to immerse it within a bath. Enough liquid, such as water, should be employed to remove unwanted material from the fabric. However, excessive amounts will necessitate large energy expenditures in the subsequent drying process. A compromise should accordingly be reached between the maximum cleaning effect using large volumes of liquid and maximum dryness of the fabric by employing lesser quantities.

Showers are typically employed for wetting the back side of a carpet. A slotted suction pipe is positioned on the face side thereof to provide vacuum cleaning action. In standard slots, the tuft of the carpet will bend away from the slot as it approaches it. This shortens the exposure time during which each tuft is subject to the vacuum cleaning. The air flow may also be directly through the carpet rather than principally through the pile. The invention provides a means for making most efficient use of the air flow within a fabric cleaning apparatus in terms of both energy consumption and cleaning ability.

The washing system 10 is shown in its entirety in FIG. 1 as a fabric 12 proceeds from a steamer (not shown) and passes therethrough. In this example the fabric is a carpet having a tufted face fiber 14 of ordinary length and a porous backing 16 of jute or other woven or non-woven material.

The carpet first passes about an idler roll 18 which is supported by one of the legs 20, 22 of the mounting assembly 24. Hot water or another appropriate liquid is directed from a first shower 25 nozzle into or before the nip between the carpet and the roller. The pressure is sufficient to wet the backing 16 of the carpet such that water will ooze therethrough. However, it should not be so great that the water blasts completely through. Pressures ranging from ten to eighty psi have been successfully employed with flows for each nozzle between one-half and two and one-half gallons per minute. A plurality of shower nozzles 25 are ordinarily employed for wetting the carpet. Their number depends upon the width of the carpet which is intended to be accommodated by the system. The nozzles 25 are mounted to a bracket 26 which is appropriately shaped for allowing the passage of the carpet 12 therethrough. The shower nozzles may be spaced between two and four inches apart.

The wet carpet proceeds from the idler roll 18 to a prolix diffuser assembly 28 including a suction pipe 30. The pipe is air tight with the exception of a slotted opening 32 having a width in the range of $\frac{1}{8}$ to $\frac{5}{8}$ inches.

A pump or other means (not shown) provides the necessary suction within the pipe. Vacuum levels between five and fifteen inches of mercury have been found to be appropriate for cleaning and drying. Carpet speeds of ten to sixty feet per minute are typically used.

It has been found that with carpeting and textile materials, better dewatering and cleaning can be achieved with a smaller volume of air at higher velocity than larger volumes at a lower velocity. If air is allowed to pass directly through a material such as unbacked carpet or an open woven textile, it will pass through the void areas in the path of least resistance. A lesser amount of water will be picked up from the surface than if a restriction or backing device is positioned behind the material at such relation to the suction slot 32 to cause the air to flow in a more indirect route. It will thereby contact more of the material surface of the substrate and promote efficient cleaning and drying. A reduced air flow is required and therefore energy requirements are also reduced.

The restricting member in FIGS. 1 and 2 is a non-porous plate 34, although it may alternatively take other forms. It may require some permeability depending on the nature of the material to be dewatered. Because the materials to be dewatered can vary in weaves, patterns and permeability, it may be necessary to use complex and/or adjustable patterns to direct air flow.

The restricting member not only causes the air to travel an indirect route, but also increases the pressure drop across the fabric. High pressure drop results in higher water removal with lesser expenditures of energy, drier carpets after the suction pipe and higher velocity air flows. The desired air flow for a particular fabric will depend on the permeability of the substrate, the total shower water added, and the dwell time over the suction pipe.

The gap d between the backup plate 34 and the slot face 35 is adjustable and must be large enough to permit air flow through the pile of the carpet to bend the tufts toward the slot. However, it must also be small enough to insure that the air flow is principally through the pile. The gap is typically set from $\frac{1}{3}$ to $\frac{7}{8}$ the carpet thickness, and best results have been achieved in the range of one quarter to five-eights inches.

The gap length g is the distance through which the carpet is subjected to the vacuum cleaning process. This length is extended considerably through the use of the backup plate 34, and cleaning begins almost as soon as the carpet enters the gap. The vacuum causes gum to move to the tips of the tufts where it can be removed as the tips of the tufts enter the slot. The tips remain in the slot for a period of time which is greater than the time the roots of the tufts spend over the slot. This is because: (1) the lengths l of the tufts are greater than the gap d between the backup device and slot face and 2) the tufts bend toward the slot as shown in FIG. 4 at an angle $\alpha$. The point at which the tips leave the slot area may be used to define the gap length. This length is approximately equal to the distance between the point at which the carpet enters the gap and the remote end of the slot plus l cos $\alpha$.

The carpet moves through the washing system 10 and to the diffuser 28 in such a manner that normal operating tensions keep the back of the carpet against the backup plate 34. This also prevents the vacuum in the slot from pulling the carpet partially therein as in a standard vacuum extractor. The parameters of the suitable slot must fit the configuration of the backup plate so as to control the length and size of the gap.

The prolix diffuser assembly 28 includes a slide plate 36 which is able to move up or down with respect to the carpet. An adjustable screw assembly 38 including a handwheel 40, handle 42, and screw 44 is used to position the slide plate 36 and backup plate 34 for each type of fabric. Cam followers 46 are provided within the frame for ease of adjustment. An indicator means 47 including a pointer 48 is provided for setting the proper gap.

The carpet passes from the diffuser assembly to a idler roll 49 where it is again wetted by a shower 50. The shower 50 and roll 49 operate in about the same manner as the shower 25 and idler roll 18 described above. The second idler roll 49 is included within an adjustable frame assembly 52 having a nut and screw adjustment means 54. By employing the adjustment, the roll 49 may be positioned at the desired height.

The water extraction and cleaning process is repeated by a second prolix diffuser assembly 28. Since the assembly is identical with the one described above, the same numerals are used to identify the same parts within the drawings.

From the second diffuser assembly, the carpet proceeds to an idler roll 56, pin drive roll 58, and an idler roll 60, respectively. A pan assembly 62 with a drain is provided beneath the diffuser assemblies 28 for collecting water which may overflow or drain from the system.

In operation, the carpet is wetted with hot water from the first shower nozzle 25. Water jets are directed into the nip between the roll 18 and the carpet 12 and puddles through the carpet. The water reduces the gum viscosity and particularly when applied to the back 14, washes the gum towards the tips of the tufts.

The air flows through the face of the carpet in the gap towards the vacuum slot. With the proper gap dimensions, the tufts are bent so that the tips are pointed downstream towards the slot. The air flow tends to further bring the gum toward the tip of the tuft.

The tip of the tuft enters the vacuum slot due to its downstream deflection before the root of the tuft is opposite the slot. Air flow keeps each individual tuft in the slot until its root has passed thereover and downstream a sufficient distance to physically pull the tuft out of the slot. The time each tuft spends in the slot is accordingly greater than in a standard vacuum slot, and allows the air flow to more effectively remove the gums concentrated towards the tip of the tuft by the previous hot water wash. FIG. 2 shows the air flow and deflection of tufts within the diffuser.

The indirect path taken by the air as it travels around the plate and through the pile, coupled with its relatively high velocity, promote the dewatering operation. It has been found that the use of a backup device with the suction pipe reduces the air flow requirements on unbacked carpet by a factor of approximately 2:1. The energy demands of the system are accordingly smaller.

The entire process is repeated as a second shower nozzle, idler roll, and diffuser are employed. A thorough cleaning and drying operation is thereby provided.

As the carpet leaves the slot in either of the two diffuser assemblies, the air flow through the pile towards the slot (which is now upstream) may add incremental improvement in the washing.

A second embodiment of the invention is shown in FIG. 5. The gap width is controlled by raising the slot exit surface 64 an appropriate distance above the slot entrance surface 66 to hold the carpet in the proper position. The entrance and exit surface form a stepped structure as shown in the drawing. It is thereby possible to use a flexible backup device 68 to prevent air flow through the carpet since pressure of the carpet back against said device is not required. The system is advantageous in that most of the air flow will be in the downstream direction as a seal is formed between the backup device and exit surface. Higher air velocity is thereby possible.

Alternative means may be employed for deflecting the tufts toward the vacuum slot. A porous coveyor belt moving faster than the carpet and between the carpet face and slot could serve this function.

Those skilled in the art will appreciate that modifications can be made in the system described above without departing from the spirit of the invention. Single or multislotted suction pipes may be utilized and the operating parmeters can be changed depending upon the fabric to be treated. The scope of the invention should accordingly be determined by reference to the appended claims.

What is claimed is:

1. A system adapted for cleaning and drying porous fabrics, comprising:

means for passing a porous fabric having a face side and a back side in a downstream direction and at an appropriate speed;

means for applying liquid to said fabric;

means for applying suction to the face side of said fabric positioned downstream from said means for applying liquid;

backup means positioned opposite said means for applying suction such that said fabric will pass in a gap between said backup means and said means for applying suction; and said means for applying suction including a vacuum slot defined by a stepped structure including a slot entrance surface and a slot exit surface over which a fabric may pass, said slot exit surface having a greater height than said slot entrance surface.

2. A system as claimed in claim 1 further including means for adjusting the gap between said backup means and said means for applying suction.

3. A system as claimed in claim 1 wherein said means for applying suction is a vacuum pipe having a slotted opening.

4. A system as claimed in claim 1 adapted for cleaning and drying carpet.

5. A system as claimed in claim 1 wherein said backup means is of flexible material.

6. A system as claimed in claim 5 wherein said means for applying suction and said backup means are constructed for allowing air to pass substantially only in one direction through said gap when a fabric is positioned therebetween.

7. A system as claimed in claim 1 wherein said means for applying liquid include shower nozzles adapted for spraying hot water at a rate approximately between one-half and two and one-half gallons per minute and at a pressure between ten and eighty pounds per square inch, said means for applying suction adapted for providing a vacuum in the range of five to fifteen inches of mercury.

8. A system as claimed in claim 1 wherein said means for applying liquid is positioned for applying liquid to the back side of a tufted carpet while said means for applying vacuum pressure is positioned for cleaning and drying the tufted face side of said carpet.

9. A method for cleaning and drying a porous fabric such as carpet comprising the steps of:

wetting a fabric;

passing said fabric through a gap between a vacuum source and backup means positioned opposite said source, said backup means preventing the flow of air directly through said fabric and causing it to flow in an indirect route into said vacuum source; and arranging said vacuum source and said backup means such that air flows substantially only in one direction through said fabric and gap into said vacuum source.

10. A method as claimed in claim 9 wherein said fabric is a carpet having a back side and a tufted face side comprising the steps of wetting said carpet on the back side and applying a vacuum to the tufted face side of said carpet.

11. A method as claimed in claim 9 wherein said fabric is a carpet having a back side and a tufted face side and the vacuum source is a slotted opening in a vacuum pipe, further including the step of causing the tips of said tufts to be deflected towards said slot before the roots of said tufts are directly opposite said slot.

12. A device for extracting liquid from a porous fabric comprising:

a vacuum source, said source including a vacuum slot defined by a stepped structure including a slot entrance surface and a slot exit surface over which a fabric may pass, said slot exit surface having a greater height than said slot entrance surface; and backup means positioned opposite said vacuum source such that said fabric must pass through a gap between said vacuum source and said backup means.

13. A device as claimed in claim 12 wherein said vacuum source is a vacuum pipe having a slotted opening.

14. A device as claimed in claim 12 wherein said vacuum source is adapted for providing a vacuum in the range of five to fifteen inches of mercury.

15. A device as claimed in claim 12 wherein said backup means is adapted to be positioned against the back side of a tufted carpet and said vacuum source is positioned for cleaning and drying the tufted face side of said carpet.

16. A device as claimed in claim 12 further including means for adjusting the gap between said vacuum source and backup means.

17. A device as claimed in claim 12 wherein said backup means is of flexible material.

18. A device as claimed in claim 12 wherein said vacuum source and backup means are adapted for allowing air to pass substantially only in one direction through said gap when a fabric is positioned therebetween.

19. A method as claimed in claim 9 including the step of providing a vacuum source having a stepped configuration including a slot entrance surface, a slot exit surface of greater height than said slot entrance surface, and a vacuum slot defined between said surfaces; and forming a seal between the backup means and slot exit surface as a fabric passes therebetween such that air substantially only flows through the gap between said slot entrance surface and said backup means into said vacuum slot.

* * * * *